US006899188B2

(12) United States Patent
Hughes et al.

(10) Patent No.: US 6,899,188 B2
(45) Date of Patent: May 31, 2005

(54) DOWN HOLE DRILLING ASSEMBLY WITH CONCENTRIC CASING ACTUATED JET PUMP

(75) Inventors: William James Hughes, Tulsa, OK (US); Jimmie Josh Renfro, Plano, TX (US)

(73) Assignee: Sunstone Corporation, Oklahoma City, OK (US)

( * ) Notice: Subject to any disclaimer, the term of this patent is extended or adjusted under 35 U.S.C. 154(b) by 86 days.

(21) Appl. No.: 10/397,328

(22) Filed: Mar. 26, 2003

(65) Prior Publication Data

US 2004/0188143 A1 Sep. 30, 2004

(51) Int. Cl.[7] ..... E21B 7/00
(52) U.S. Cl. ..... 175/57; 175/231
(58) Field of Search ..... 175/65, 215, 231, 175/310, 324, 57, 308

(56) References Cited

U.S. PATENT DOCUMENTS

| | | | | |
|---|---|---|---|---|
| 2,234,454 A | | 3/1941 | Richter | 255/24 |
| 2,946,565 A | | 7/1960 | Williams | |
| 3,087,558 A | | 4/1963 | Dougherty, Jr. | 175/65 |
| 3,208,539 A | | 9/1965 | Henderson | 175/215 |
| 3,948,330 A | | 4/1976 | Langford, Jr. | 175/339 |
| 4,022,285 A | | 5/1977 | Frank | 175/65 |
| 4,239,087 A | | 12/1980 | Castel et al. | 175/340 |
| 4,436,166 A | | 3/1984 | Hayatdavoudi et al. | 175/65 |
| 4,534,426 A | * | 8/1985 | Hooper | 175/65 |
| 4,567,954 A | | 2/1986 | Voight, III et al. | |
| 4,630,691 A | * | 12/1986 | Hooper | 175/65 |
| 4,687,066 A | | 8/1987 | Evans | 175/340 |
| 4,744,730 A | | 5/1988 | Roeder | |
| 5,355,967 A | * | 10/1994 | Mueller et al. | 175/65 |
| 5,372,190 A | * | 12/1994 | Coleman | 166/68 |
| 5,456,326 A | | 10/1995 | Raines | |
| 5,562,171 A | | 10/1996 | Besson et al. | 175/339 |
| 5,771,984 A | | 6/1998 | Potter et al. | 175/14 |
| 5,775,443 A | | 7/1998 | Lott | 175/57 |
| 5,836,404 A | | 11/1998 | Trujillo et al. | 175/57 |
| 5,921,476 A | | 7/1999 | Akin et al. | 239/590 |
| 5,992,763 A | | 11/1999 | Smith et al. | 239/428.5 |
| 6,129,152 A | | 10/2000 | Hosie et al. | |
| 6,209,663 B1 | | 4/2001 | Hosie | 175/57 |
| 6,276,455 B1 | | 8/2001 | Gonzalez | |
| 6,497,290 B1 | * | 12/2002 | Misselbrook et al. | 166/384 |
| 6,769,498 B2 | * | 8/2004 | Hughes | 175/65 |
| 2002/0170749 A1 | | 11/2002 | Hoyer et al. | |

FOREIGN PATENT DOCUMENTS

EP 1 288 434 A1 5/2003

* cited by examiner

*Primary Examiner*—Frank Tsay
(74) *Attorney, Agent, or Firm*—Rudolf O. Siegesmund

(57) ABSTRACT

A concentric casing actuated jet pump is disclosed that induces artificial lift to remove the drilling and production fluid from a well bore during drilling operations by means of a single or multiple hydraulic jet pumps attached to a concentric string of casing. The invention includes a drill string that passes through the jet pump assembly so that the power fluid is separated from the drilling fluid until it enters the jet pump. The jet pump assembly is joined to a concentric casing string. The jet pump also contains a bladder element that inflates or expands to redirect the flow of the drilling and production fluid from the inner annulus into the jet pump assembly. Vertical displacement of the inner casing string by a casing jack causes the bladder to redirect the flow of drilling fluid form the inner annulus into the jet pump assembly.

50 Claims, 6 Drawing Sheets

DOWN HOLE DRILLING ASSEMBLY WITH CONCENTRIC CASING ACTUATED JET PUMP

CROSS-REFERENCE TO RELATED APPLICATION

The present invention is related to the subject matter of U.S. patent application Ser. No. 09/946,849 entitled "Downhole Drilling Assembly with Independent Jet Pump" and Ser. No. 09/971,308 entitled "Concentric Casing Jack", both of which are incorporated herein by reference.

FIELD OF INVENTION

The present invention relates generally to oilfield drilling devices and methods and specifically, to an apparatus and method for inducing under balanced drilling conditions by artificially lifting the drilling fluid and the formation fluid with a jet pump assembly affixed to an inner casing section while simultaneously drilling with a drill bit and drill pipe that passes through the jet pump assembly.

BACKGROUND

In order to produce fluids such as oil, gas, and water from subterranean rock formations, a well is drilled into the fluid-bearing zone. Most wells are generally drilled with a drilling rig, a drill bit, a drill pipe, and a pump for circulating fluid into and out of the well bore. The drilling rig rotates and lowers the drill pipe and drill bit to penetrate the rock. Drilling fluid, sometimes referred to as drilling mud, is pumped down the drill pipe through the drill bit to cool and lubricate the action of the drill bit as it disaggregates the rock. In addition, the drilling fluid removes particles of rock, known as cuttings, generated by the rotational action of the drill bit. The cuttings become entrained in the column of drilling fluid as it returns to the surface for separation and reuse. The column of drilling fluid also serves a second purpose by providing pressure in the form of hydrostatic weight, which prevents seepage from the formation into the well. When the weight of the column of drilling fluid is used to prevent seepage, the hydrostatic pressure of the column of drilling fluid exceeds the pressure contained within the formation, a drilling condition referred to as over balanced drilling.

A desired condition when drilling is to prevent drilling fluids from penetrating the surrounding rock and contaminating the reservoir. Another desired condition is to allow any fluid such as oil contained in the reservoir to flow into the well bore above the drill bit so that production can be obtained during the drilling process. Both of these conditions can be achieved by lowering the bottom hole pressure, or in other words, lowering the hydrostatic pressure that is exerted by the column of fluids in the well bore to a point that is below the pore pressure which exists within a rock formation. Lowering the bottom hole pressure within a well bore while drilling below the formation pressure to accomplish either of these goals is referred to as under balanced drilling.

Conventional under balanced drilling intentionally reduces the density of fluids contained in the well bore. In conventional under balanced drilling, the reduction in the density of the fluids causes the hydrostatic pressure of the fluid column to be lower than the pressure contained within the pores of the rock formation being drilled. When a reduction in density causes the hydrostatic pressure of the fluid column to be lower than the pore pressure, fluids in the reservoir may flow into the well bore while it is being drilled. Under balanced drilling has gained popularity in the upstream oil and gas industry because it does not allow the drilling fluids to penetrate the surrounding rock and damage the permeability of the reservoir.

The under balanced condition is usually achieved by injecting a density reducing agent such as air, nitrogen, exhaust, or natural gas into the fluids that are being pumped down the drill pipe during the process of drilling a well. The injected gas combines with the drilling fluid and reduces its density and thus lowers the hydrostatic pressure that exists in the annulus between the drill pipe and the wall of the well bore. The concentric casing technique is a common method for delivering the gas to the bottom of the well by utilizing a second string of casing hung in the well bore inside the production casing. The injected gas flows down to the bottom of the well through the outer annulus created by the two strings of casings. The drilling fluid, delivered via the drill pipe, and any produced fluid combine with the injected gas as it flows upwards through the inner annulus between the second or concentric string of casing and the drill pipe. The process may be reversed such that the inner annulus is used for injection and the outer annulus is used for well effluent. The use of gas as a density reducing agent has distinct disadvantages. First, if air is used, the risk of down hole fires and corrosion problems are invited. Second, if an inert gas such as nitrogen is used, the expense may be prohibitive. In either case, the cost of compression that is required by all types of gas at the surface is significant.

Another method for lowering bottom hole pressure is by artificially inducing lift to remove fluids from a well by using a jet pump and a power fluid. The use of jet pumps is common in production operations where drilling activity has stopped. In this case, the drill pipe and drill bit have been extracted and a jet pump is lowered into the well on the end of a tubing string. A surface pump delivers high-pressure power fluid down the tubing and through the nozzle, throat, and diffuser of the jet pump. The pressure of the power fluid is converted into kinetic energy by the nozzle, which produces a very high velocity jet of fluid. The drilling and production fluids are drawn into the throat of the jet pump by the stream of high velocity power fluid flowing from the nozzle into the throat of the jet pump. The drilling and production fluids mix with the power fluid as they pass through the diffuser. As the fluids mix, the diffuser converts the high velocity mixed fluid back into a pressurized fluid. The pressured fluids have sufficient energy to flow to the surface through the annulus between the production casing and the tubing that carried the jet pump into the well.

While jet pumps are used for removing fluid from a well by lowering down hole pressure in production wells, the advantages of under-balanced drilling would be enhanced significantly if a jet pump could be combined with drilling operations. The jet pump could be employed to achieve under-balanced conditions while the drill string is down in the hole and the drill bit is operating. By using a power fluid such as water, the disadvantages of gas could be avoided altogether thereby increasing safety and decreasing costs. Attempts have been made to place jet pumps into drill bits. However, when the jet pump is placed in the drill bit, the drilling fluid serves a dual purpose and becomes the power fluid before entering the nozzle of the jet pump. When the power fluid and the drilling fluid are one in the same and enter the nozzle of the jet pump, the extreme abrasiveness of the drilling fluid can cause the jet pump to wear out prematurely.

Casing jacks are also well known in the art. A casing jack is an apparatus for raising and lowering a casing string suspended in a well bore. Casing jacks are the subject matter of U.S. patent application Ser. No. 09/971,308 entitled "Concentric Casing Jack" as well as U.S. Pat. Nos. 6,019,175 and 6,009,941. Persons skilled in the art are aware of other methods of raising and lowering a casing string in a well bore. As casing jacks are a common piece of equipment used in drilling operations, a need exists for an apparatus and method of inducing under balanced drilling conditions in which the jet pump bladder element is actuated using a casing jack or similar apparatus.

What is needed beyond the prior art is a jet pump connected to a concentric casing string that will induce artificial lift while allowing the drill bit to operate independently of the jet pump. What is further needed beyond the prior art is a jet pump connected to a concentric casing string that will keep the power fluid separate from the drilling fluid until after the power fluid has passed through the nozzle of the jet pump. What is still further needed beyond the prior art is a concentric casing jet pump that can be actuated using a casing jack.

SUMMARY OF INVENTION

A concentric casing actuated bladder element of the jet pump is disclosed that induces artificial lift to remove the drilling and production fluid from a well bore during drilling operations by means of a single or multiple hydraulic jet pumps attached to a concentric string of casing. The invention includes a drill string that passes through the jet pump assembly so that the power fluid is separated from the drilling fluid until it enters the jet pump. The jet pump assembly is joined to a concentric casing string. The jet pump also contains a bladder element that inflates or expands to redirect the flow of the drilling and production fluid from the inner annulus into the jet pump assembly. Vertical displacement of the inner casing string by a casing jack causes the bladder to redirect the flow of drilling fluid from the inner annulus into the jet pump assembly.

BRIEF DESCRIPTION OF DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DESCRIPTION OF PREFERRED EMBODIMENT

As used herein, the term jet pump means an apparatus having a nozzle, a throat, and a diffuser which transfers energy from a power fluid to a drilling and/or production fluid to artificially lift and remove drilling and produced fluids from a well thereby decreasing the hydrostatic weight of the combined fluid column. As used herein, the term bladder means a device that inflates from a first position into a second position to make contact with a drill string or casing and diverts the return flow of fluids through the jet pump.

Figure 1:
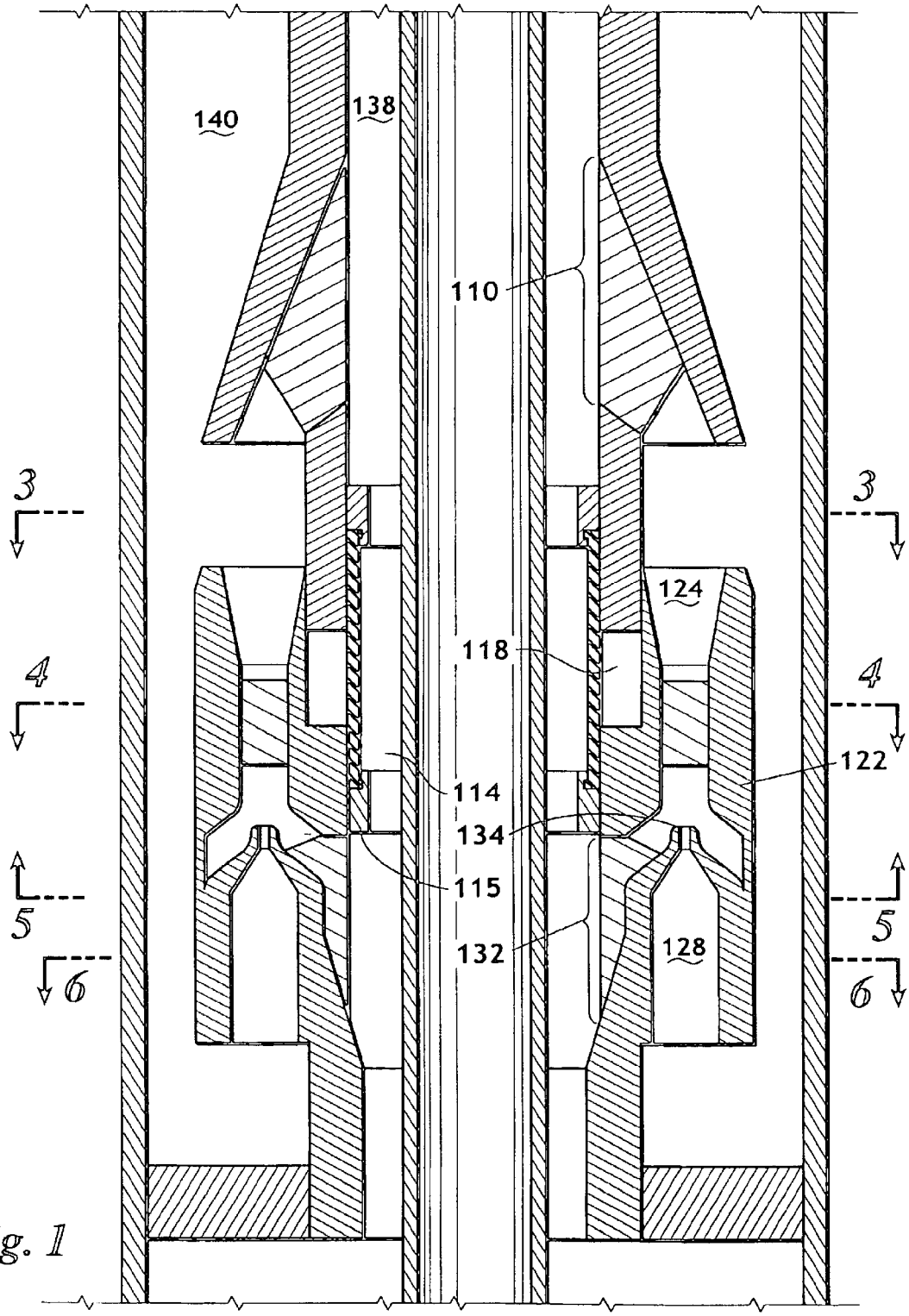
FIG. 1 is a cross-sectional elevation view of the present invention showing the inner casing upper section in the raised position.

As seen in FIG. 1, the well bore is lined with production casing 102, which separates outer annulus 140 from the earth. Packer 104 expands to fit production casing 102. The inner casing is concentric with and has a smaller diameter than production casing 102. The inner casing comprises inner casing upper section 106, inner casing middle section 120, and inner casing lower section 136. The inner casing extends downwardly from the surface and is affixed to packer 104. The inner casing and production casing 102 form outer annulus 140, which extends up to the surface and is closed at the bottom by packer 104. Outer annulus 140 contains a power fluid, which is pressurized from the surface. Drill string 108 is inserted inside the inner casing and inner annulus 138 is created between drill string 108 and the inner casing. A drilling fluid flows from the surface through the middle of drill string 108 to the bottom of the well bore and then flows upwards through the annular region between drill string 108 and production casing 102. When the drilling fluid reaches packer 104, it flows up through inner annulus 138.

Inner casing lower section 136 screws into and extends upwardly from packer 104. Jet pump inlet 132 comprises a plurality of apertures in inner casing lower section 136. Chamber wall 130 extends upwardly and outwardly from inner casing lower section 136 and contains chamber 128. Chamber 128 is a cavity in chamber wall 130 and allows the power fluid in outer annulus 140 to flow through a small aperture in nozzle 134. Throat 126 is located above nozzle 134. Throat 126 is the area where the power fluid and the drilling fluid mix when the concentric casing actuated jet pump 100 is utilized. The throat 126 is defined by chamber wall 130 and nozzle 134 on its lower side and by diffuser wall 122 on its upper side. The upper portion of throat 126 leads into diffuser 124 where the combination of drilling fluid and power fluid homogenizes.

Diffuser wall 122 is also connected to inner casing middle section 120. Inner casing middle section 120 contains a cylindrical cavity 118. A cavity fluid such as water or oil fills cavity 118. Cavity 118 is defined by inner casing middle section 120 on its bottom side and its outside. Cavity 118 is defined by bladder 116 on its inside. Cavity 118 is defined by cylindrical ram 112 on its upper side. Ram 112 is sized to completely fill cavity 118 when the inner casing is moved into the lowered position. When ram 112 is lowered into cavity 118, the cavity fluid will deform bladder 116 outwardly into inner annulus 138. Bladder 116 is held in place by bladder element supports 115. Jet pump outlets 110 are a plurality of apertures in inner casing upper section 106, similar to jet pump inlets 132 in inner casing lower section 120. Inner casing upper section 106 extends upwardly from concentric casing actuated jet pump 100 to the surface.

With the inner casing in the raised position, as seen in FIG. 1, the drilling fluid bypasses jet pump inlet 132 and continues upwardly through inner annulus 138. The drilling fluid continues upwardly through jet pump bypass 114 and past jet pump outlets 110. With the inner casing in the raised position, the drilling fluid will continue upwardly through inner annulus 138 until it reaches the surface.

The method of inducing lift to remove drilling and production fluid involves injecting power fluid through a nozzle so that when the power fluid exits the nozzle, a pressure differential is created that draws in drilling and production fluid. The power fluid enters the throat where the power fluid combines with the drilling fluid and the production fluid. When the power fluid combines with the drilling fluid and the production fluid, the high velocity power fluid converts the drilling fluid and production fluid into a combined pressurized fluid called an effluent, which has sufficient energy to flow to the surface. This process reduces the pressure of effluent, by reducing the hydrostatic weight of the fluid column above concentric casing actuated jet pump 100. The reduction in the hydrostatic weight in turn reduces the pressure in the well bore below concentric casing actuated jet pump and allows the production fluid in the reservoir to flow into well bore. This method of inducing lift can be utilized during the drilling process and is attached to inner casing upper section 106 rather than drill string 108.

Figure 2:
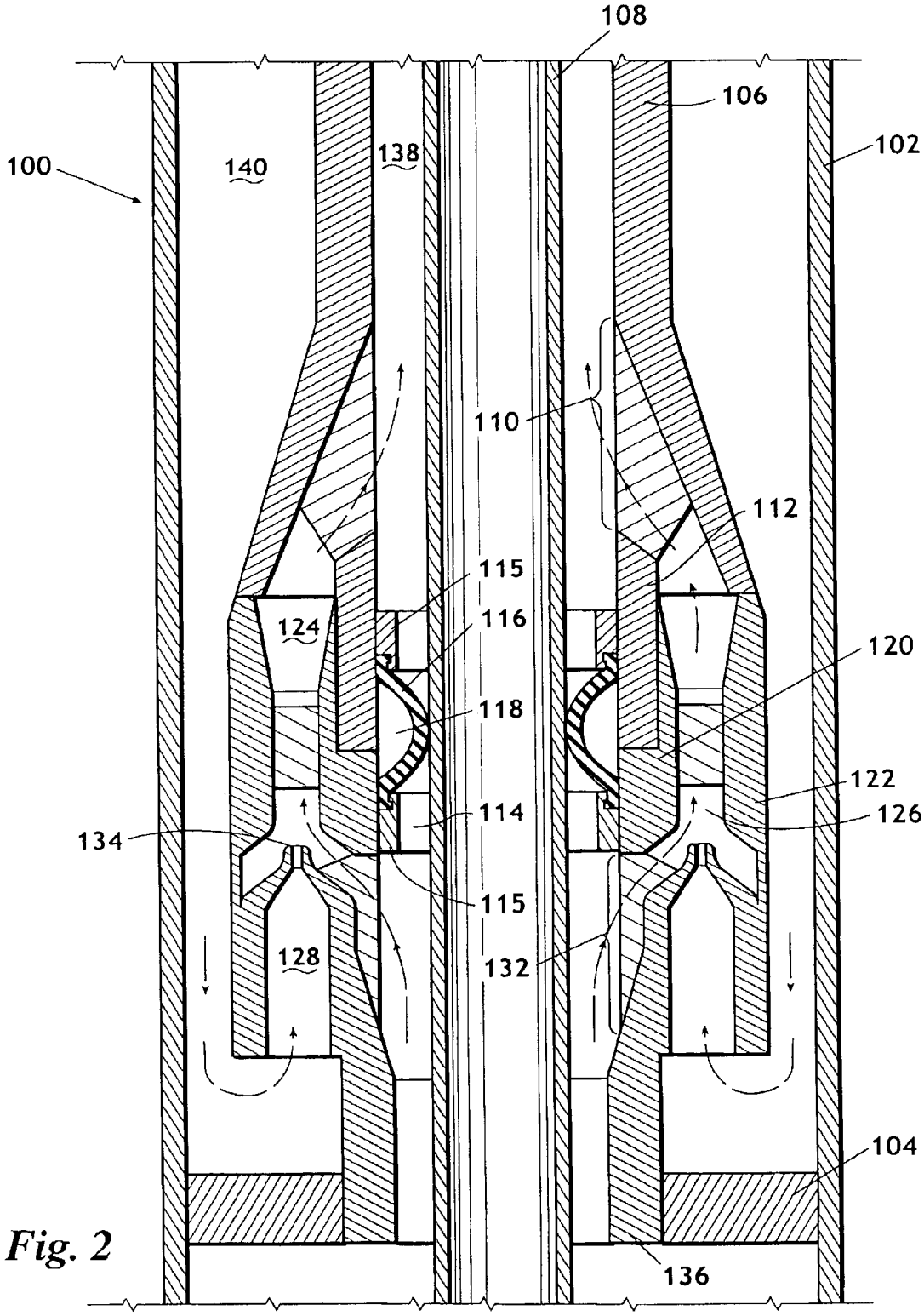
FIG. 2 is a cross-sectional elevation view of the present invention showing the inner casing upper section in the lowered position.

FIG. 2 is an illustration of concentric casing actuated jet pump 100 with the inner casing in the lowered position. Ram 112 has filled cavity 118 and displaced the cavity fluid. The displaced cavity fluid deforms bladder 116 such that it contacts drill string 108 and stops the flow of drilling fluid through jet pump bypass 114. With jet pump bypass 114 blocked, the drilling fluid is forced to enter jet pump inlet 132. After passing though jet pump inlet 132, the drilling fluid enters throat 126 and surrounds nozzle 134.

After lowering of the inner casing, a surface pump begins to pump the power fluid into outer annulus 140. The power fluid circulates down the outer annulus 140 and into chamber 128. As the power fluid passes through nozzle 134, its velocity increases. The high speed power fluid then enters throat 126 where it mixes with the drilling fluid and forms the effluent. The effluent passes through the diffuser 124 where the effluent becomes a relatively homogenous mix of drilling fluid, production fluid, drilling fines, and power fluid. The effluent then passes through jet pump outlets 110 and back into inner annulus 138. The effluent then proceeds to the surface where it is separated by a surface separator.

Figure 3:
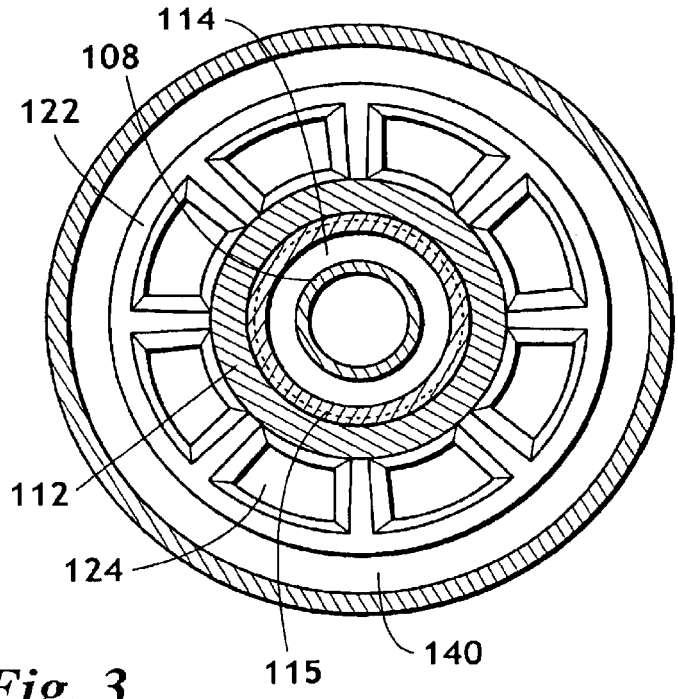
FIG. 3 is a cross-sectional plan view of the present invention taken along line 3—3 in FIG. 1.

FIG. 3 is a cross-sectional view looking downward at the concentric casing actuated jet pump 100 taken along line 3—3 in FIG. 1. Drill string 108 is shown in the center of FIG. 3. Jet pump bypass 114 is shown bordered by drill string 108 and bladder element support 115. Bladder element support 115 is adjacent to ram 112. Eight diffusers 124 can be seen depicted in the embodiment in FIG. 3. Diffuser wall 122 separates the diffusers 124 from the outer annulus 140. Production casing 102 is also shown.

In FIG. 3, the power fluid flows downward (into the page) through outer annulus 140. The drilling fluid flows downward through the center on the drill string 108. The drilling fluid with the drilling fines then flows back up (out of the page) though jet pump bypass 114. If the inner casing is lowered as depicted in FIG. 2, then the effluent would flow upward through diffusers 124.

Figure 4:
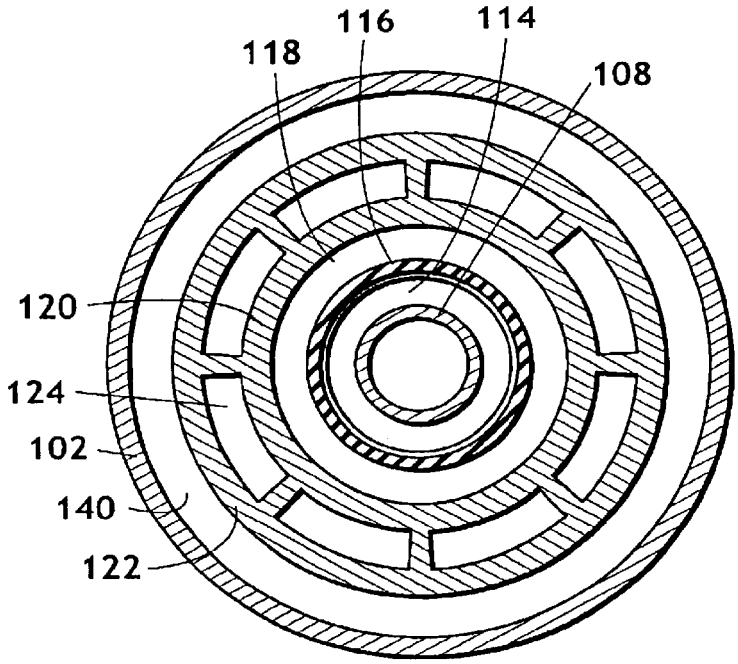
FIG. 4 is a cross-sectional plan view of the present invention taken along line 4—4 in FIG. 1.

FIG. 4 is a cross-sectional view looking downward at the concentric casing actuated jet pump 100 taken along line 4—4 in FIG. 1. Drill string 108 is shown in the center of FIG. 4. Jet pump bypass 114 is shown bordered by drill string 108 and bladder 116. Bladder 116 separates jet pump bypass 114 and cavity 118. Inner casing middle section 120 is also shown. Eight diffusers 124 can be seen depicted in the embodiment in FIG. 4. Diffuser wall 122 separates the diffusers 124 from the outer annulus 140. Production casing 102 is also shown.

In FIG. 4, the power fluid flows downward through outer annulus 140. The drilling fluid flows downward through the center on the drill string 108. The drilling fluid with the drilling fines then flows back up though jet pump bypass 114. If the inner casing is lowered as depicted in FIG. 2, then the effluent would flow upward through diffusers 124.

Figure 5:
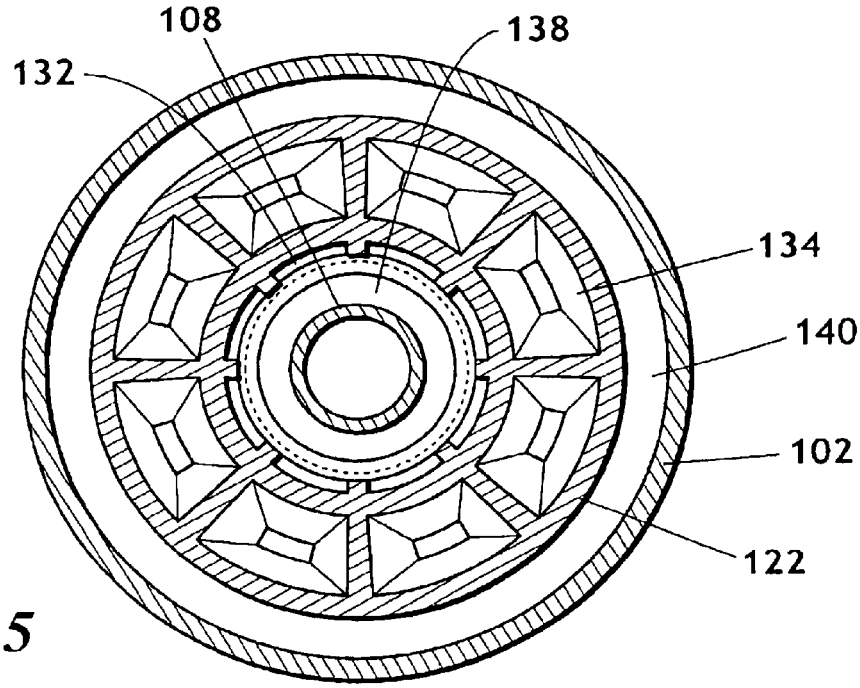
FIG. 5 is a cross-sectional plan view of the present invention taken along line 5—5 in FIG. 1.

FIG. 5 is a cross-sectional view looking downward at the concentric casing actuated jet pump 100 taken along line 5—5 in FIG. 1. Drill string 108 is shown in the center of FIG. 5. Inner annulus 138 is shown adjacent to drill string 108. Jet pump inlet 132 allows the drilling fluid to pass from inner annulus 138 to throat 126. Eight nozzles 134 can be seen depicted in the embodiment in FIG. 5. Diffuser wall 122 separates throats 126 from the outer annulus 140. Production casing 102 is also shown.

In FIG. 5, the power fluid flows downward through outer annulus 140. The drilling fluid flows downward through the center on the drill string 108. The drilling fluid with the drilling fines then flows back up though inner annulus 138. If the inner casing is lowered as depicted in FIG. 2, then the drilling fluid would flow upward through jet pump inlet 132 into throat 126. The high velocity power fluid would also be exiting nozzles 134 in an upwardly direction.

Figure 6:
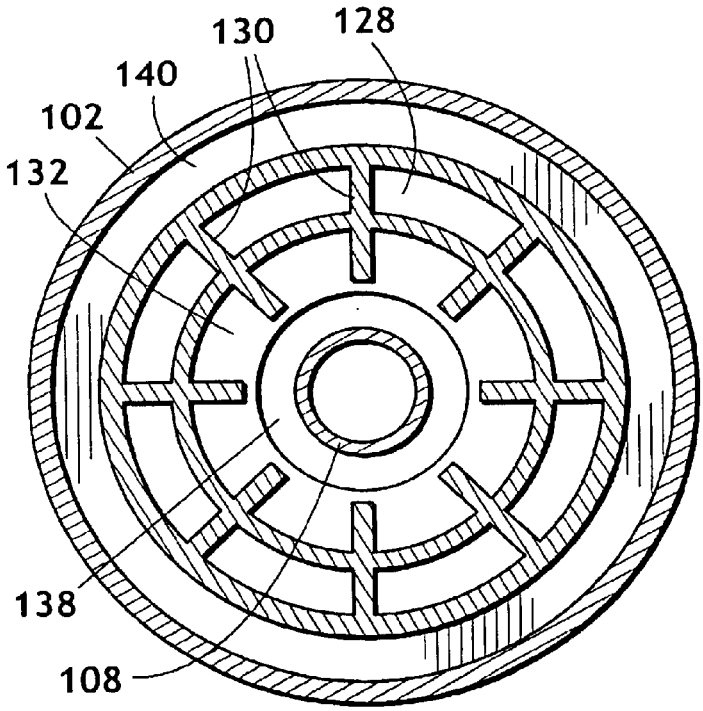
FIG. 6 is a cross-sectional plan view of the present invention taken along line 6—6 in FIG. 1.

FIG. 6 is a cross-sectional view looking downward at the concentric casing actuated jet pump 100 taken along line 6—6 in FIG. 1. Drill string 108 is shown in the center of FIG. 6. Inner annulus 138 is shown adjacent to drill string 108. Jet pump inlet 132 allows the drilling fluid to pass from inner annulus 138 to throat 126. Eight chambers 128 defined by chamber wall 130 can be seen depicted in the embodiment in FIG. 6. Chamber wall 130 separates chambers 128 from the outer annulus 140. Production casing 102 is also shown.

In FIG. 6, the power fluid flows downward through outer annulus 140. The drilling fluid flows downward through the center on the drill string 108. The drilling fluid with the drilling fines then flows back up though inner annulus 138. If the inner casing is lowered as depicted in FIG. 2, then the drilling fluid would flow upward through jet pump inlet 132. The high velocity power fluid would also be flowing upwardly through chamber 128.

Figure 7:
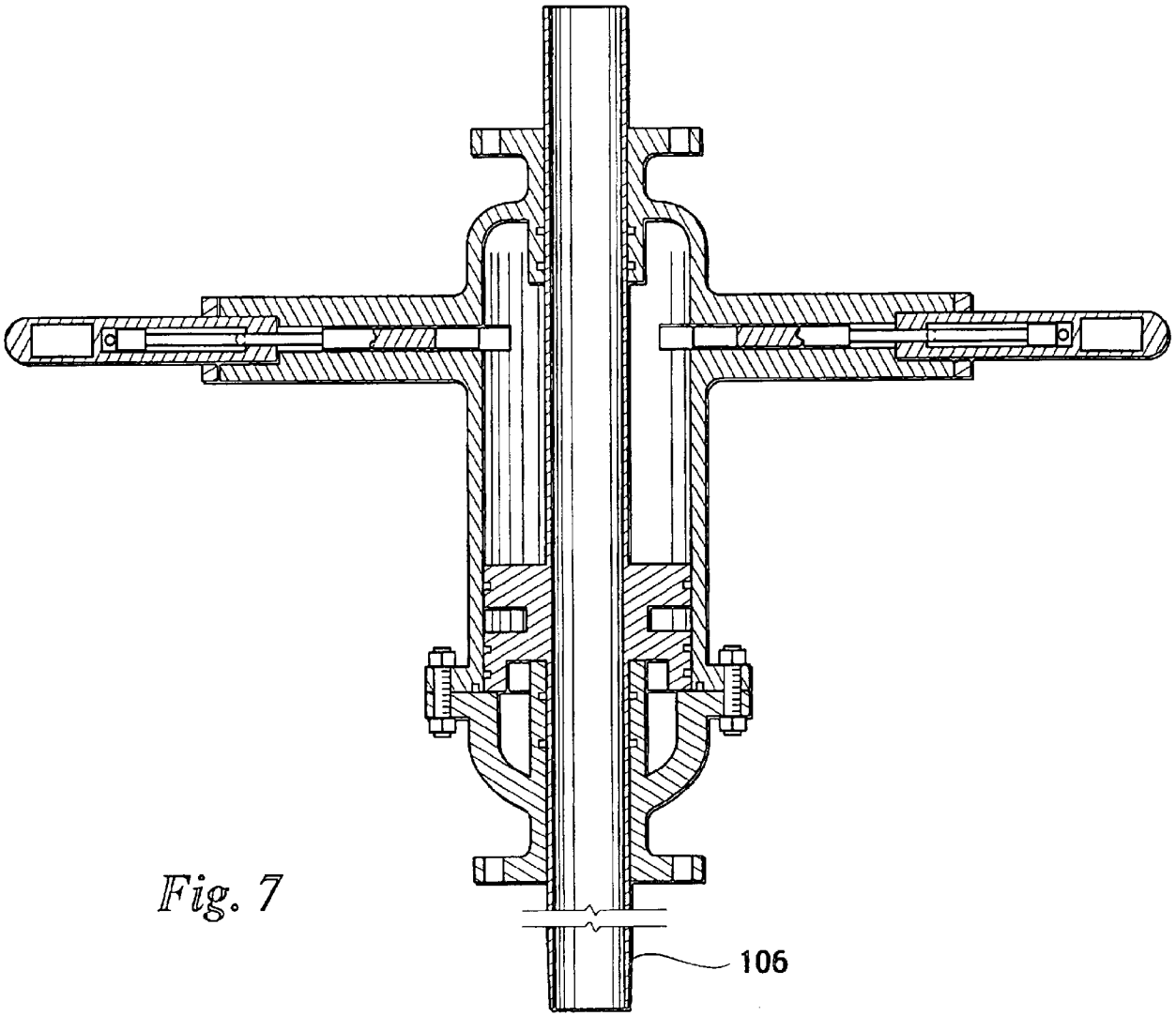
FIG. 7 is a cross-sectional elevation view of a concentric casing jack with the inner casing in the lowered position.

FIG. 7 is an illustration of a concentric casing jack. The casing jack is connected to the inner casing upper section 106 and is able to raise and lower the inner casing. Casing jacks are well known in the art as evidenced by U.S. patent application Ser. No. 09/971,308 entitled "Concentric Casing Jack". Casing jacks are also the subject matter of U.S. Pat. Nos. 6,019,175 and 6,009,941. The casing jack in FIG. 7 is depicted with the inner casing in the lowered position.

Figure 8:
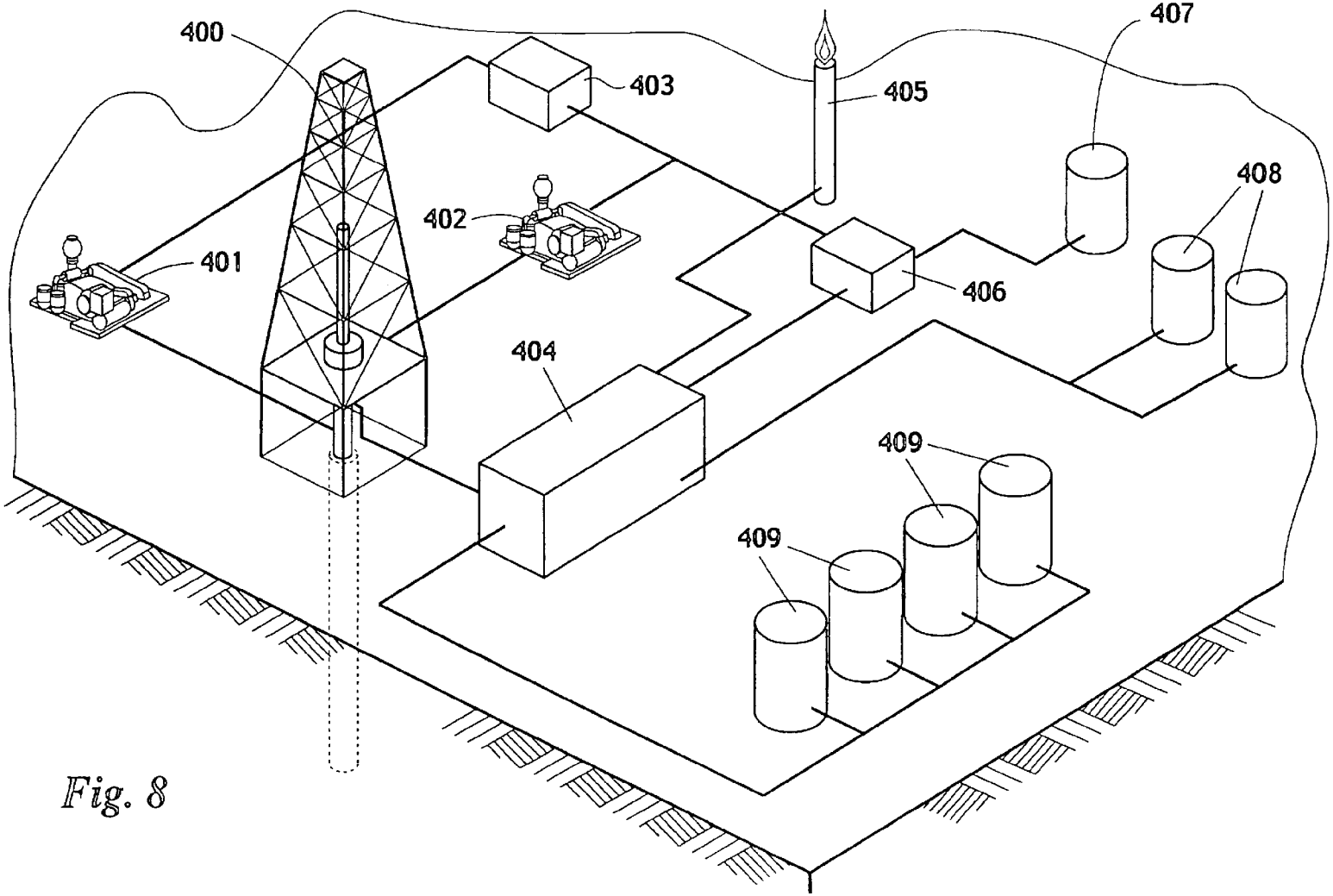
FIG. 8 is a perspective view of the surface equipment typically used to perform drilling operation using the present invention.

FIG. 8 displays the surface equipment that is needed to drill an under balanced well using the present invention. Some of the equipment shown such as drilling derrick 400, drilling fluid pump 402, and mud tank/solids control equipment 406 are used in most conventional drilling operations. Other equipment for under balanced drilling, such as four-phase (oil, water, cuttings, and gas) separator 404, flare stack 405, oil storage tanks 409, produced water storage tanks 408, and drilling fluid storage tanks 407 are also shown. The additional surface equipment needed to operate the present invention is power fluid pump 401 and power fluid filtration equipment 403. A separate pump is typically used to force the power fluid down outer annulus 140 for two reasons. First, power fluid pump 401 needs to operate at much higher pressures than drilling fluid pump 402. Second, power fluid 200 needs to be filtered so that it does not prematurely erode nozzles 134 in the jet pump. The drilling fluid 201 that is pumped and circulated down the drill string 108 by drilling fluid pump 402 contains "drilling fines" that are generated from the rock being drilled, hence the name mud, and would not be suitable to pass through a small jet pump nozzle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An apparatus comprising:

a jet pump;

a plurality of casing sections;

wherein at least one of said plurality of casing sections is vertically displaced to activate said jet pump; and wherein said jet pump reduces the hydrostatic weight of a fluid column in a wellbore.

2. The apparatus of claim 1 wherein said jet pump further comprises a nozzle, a throat, and a diffuser.

3. The apparatus of claim 1 further comprising a bladder; wherein said bladder redirects the flow of a fluid into said jet pump.

4. The apparatus of claim 3 wherein said bladder extends from an inner casing to a drill string.

5. The apparatus of claim 3 wherein a ram is connected to said at least one of said plurality of casing sections and vertical displacement of said ram causes said bladder to redirect the flow of said fluid into said jet pump.

6. The apparatus of claim 1 wherein a power fluid flows downward through an outer annulus and into said jet pump through a chamber.

7. The apparatus of claim 1 wherein a drilling fluid flows downward through a drill string and upward through an inner annulus.

8. The apparatus of claim 1 wherein raising said at least one of said plurality of casing sections causes a drilling fluid to bypass said jet pump.

9. The apparatus of claim 1 wherein lowering said plurality of casing sections causes a drilling fluid to bypass said jet pump.

10. The apparatus of claim 1 further comprising a casing jack; wherein said casing jack vertically displaces said plurality of casing sections.

11. The apparatus of claim 1 further comprising a drilling rig, a separator, and a plurality of pumping equipment.

12. A method of inducing under balanced drilling conditions comprising:

vertically displacing a casing string;

directing a drilling fluid into a jet pump;

wherein a power fluid flows into said jet pump and reduces the hydrostatic weight of a fluid column in a well bore.

13. The method of claim 12 wherein said jump pump further comprises a nozzle, a throat and a diffuser.

14. The method of claim 12 wherein a bladder redirects the flow of said drilling fluid into said jet pump.

15. The method of claim 14 wherein said bladder extends from an inner casing to a drill string.

16. The method of claim 14 wherein a ram is connected to a casing section of the casing string and vertical displacement of said ram causes said bladder to redirect the flow of said fluid into said jet pump.

17. The method of claim 12 wherein a power fluid flows downward through an outer annulus and into said jet pump through a chamber.

18. The method of claim 12 wherein a drilling fluid flows downward through a drill string and upward through an inner annulus.

19. The method of claim 12 wherein raising said casing string causes a drilling fluid to bypass said jet pump.

20. The method of claim 12 wherein lowering said casing string causes a drilling fluid to bypass said jet pump.

21. The method of claim 12 wherein a casing jack vertically displaces said casing string.

22. A method of creating under balanced drilling conditions utilizing equipment comprising:

a jet pump;

a plurality of casing sections;

a casing jack connected to a first one of said plurality of casing sections;

wherein said casing jack vertically displaces said first one of said plurality of casing sections to activate said jet pump; and wherein said jet pump produces in under balanced drilling conditions.

23. The method of claim 22 wherein said jump pump further comprises a nozzle, a throat, and a diffuser.

24. The method of claim 22 further comprising a bladder; wherein said bladder redirects the flow of a fluid into said jet pump.

25. The method of claim 24 wherein said bladder extends from an inner casing to a drill string.

26. The method of claim 24 wherein a ram is connected to a second one of said casings plurality of casing sections and vertical displacement of said ram causes said bladder to redirect the flow of said fluid into said jet pump.

27. The method of claim 22 wherein a power fluid flows downward through an outer annulus and into said jet pump through a chamber.

28. The method of claim 22 wherein a drilling fluid flows downward through a drill string and upward through an inner annulus.

29. The method of claim 22 wherein raising said plurality of casing causes a drilling fluid to bypass said jet pump.

30. The method of claim 22 wherein lowering said plurality of casing sections causes a drilling fluid to bypass said jet pump.

31. The method of claim 22 further comprising a casing jack; wherein said casing jack vertically displaces said plurality of casing sections.

32. The method of claim 22 further comprising a drilling rig, a separator, and a plurality of pumping equipment.

33. An apparatus for vertically displacing a drill string within a wellbore comprising:

a casing string extending downwardly from a surface;

a bladder element disposed within said casing string;

a drill string comprising a drill bit and drill pipe disposed within said casing string;

wherein said bladder element inflates from a first position into a second position to make contact with the drill string; and wherein said drill pipe is vertically displaced through said bladder element to the bottom of a wellbore.

34. The apparatus of claim 33 further comprising a jet pump; wherein said jet pump further comprises a nozzle, a throat, and a diffuser.

35. The apparatus of claim 33 wherein said bladder element redirects the flow of a fluid into said jet pump.

36. The apparatus of claim 33 wherein said bladder extends from an inner casing to a drill string.

37. The apparatus of claim 33 wherein a ram is connected to one of a said plurality of said casings sections and vertical displacement of said ram causes said bladder to redirect the flow of said fluid into said jet pump.

38. The apparatus of claim 33 wherein a power fluid flows downward through an outer annulus and into said jet pump through a chamber.

39. The apparatus of claim 33 wherein a drilling fluid flows downward through a drill string and upward through an inner annulus.

40. The apparatus of claim 33 wherein raising said casing string causes a drilling fluid to bypass said jet pump.

41. The apparatus of claim 33 wherein lowering said casing string causes a drilling fluid to bypass said jet pump.

42. The apparatus of claim 33 further comprising a casing jack; wherein said casing jack vertically displaces said casing string.

43. The apparatus of claim 33 further comprising a drilling rig, a separator, and a plurality of pumping equipment.

44. A method of vertically displacing a drill string comprising:

inserting a drill string through a bladder element;

wherein said bladder element is disposed within a wellbore;

wherein said drill string further comprises a drill pipe and a drill bit; and wherein said bladder element inflates from a first position into a second position to make contact with the drill string.

45. The method of claim 44 further comprising:

directing a drilling fluid into a jet pump; and wherein a power fluid flows into said jet pump and reduces the hydrostatic weight of a fluid column in a well bore.

46. The method of claim 45 wherein said jump pump further comprises a nozzle, a throat and a diffuser.

47. The method of claim 45 wherein said bladder element redirects the flow of said drilling fluid into said jet pump.

48. The method of claim 44 wherein said bladder element extends from a casing string to said drill string.

49. The method of claim 44 wherein a power fluid flows downward through an outer annulus and into said jet pump through a chamber.

50. The method of claim 44 wherein a drilling fluid flows downward through a drill string and upward through an inner annulus.

* * * * *

UNITED STATES PATENT AND TRADEMARK OFFICE

CERTIFICATE OF CORRECTION

PATENT NO. : 6,899,188 B2
DATED : May 31, 2005
INVENTOR(S) : Hughes et al.

It is certified that error appears in the above-identified patent and that said Letters Patent is hereby corrected as shown below:

Title page,
Item [57], ABSTRACT,
Line 14, "form" should be -- from --

Column 8,
Line 37, delete "casings"
Line 47, insert -- sections -- after "casing"

Column 9,
Line 9, "of a said plurality" should be -- of a plurality --

Column 10,
Line 15, "jump" should be -- jet --

Signed and Sealed this

Nineteenth Day of July, 2005

JON W. DUDAS
*Director of the United States Patent and Trademark Office*